US005924343A

United States Patent [19]

Bogni et al.

[11] Patent Number: 5,924,343

[45] Date of Patent: Jul. 20, 1999

[54] BOX SPANNER WITH A DEVICE FOR RETAINING THE OBJECT TO BE TURNED

[75] Inventors: Claudio Bogni, Gavirate; Daniele Gilli, Brebbia, both of Italy

[73] Assignee: Utensilerie Associate S.p.A., Monvalle, Italy

[21] Appl. No.: 08/923,836

[22] Filed: Sep. 4, 1997

[30] Foreign Application Priority Data

Sep. 6, 1996 [IT] Italy ..... MI96A1844

[51] Int. Cl.[6] ..... B25B 13/02

[52] U.S. Cl. ..... 81/125; 81/180.1

[58] Field of Search ..... 81/125, 180.1

[56] References Cited

U.S. PATENT DOCUMENTS

| | | | |
|---|---|---|---|
| 3,869,945 | 3/1975 | Zerver . | |
| 5,074,172 | 12/1991 | Fetter et al. | 81/125 |
| 5,544,555 | 8/1996 | Corley et al. | 81/125 |

FOREIGN PATENT DOCUMENTS

| | | | |
|---|---|---|---|
| 895.073 | 1/1945 | France . | |
| 3142528A1 | 5/1983 | Germany . | |
| 91 02 751 U | 7/1991 | Germany . | |
| 94 154 879 U | 1/1995 | Germany . | |
| 94 19 441 U | 2/1995 | Germany . | |
| 1464808 | 2/1977 | United Kingdom | 81/125 |

*Primary Examiner*—James G. Smith
*Attorney, Agent, or Firm*—Kirschstein, et al.

[57] ABSTRACT

A spanner for installing and removing spark plugs includes an annular peripheral groove extending around an external peripheral surface of a socket end of a tubular member. A group of radial passages extends from the groove through the tubular member to a seat of the socket end. Permanent magnets are mounted in the passages. An annular band is mounted in the groove and exteriorly covers the magnets.

15 Claims, 2 Drawing Sheets

BOX SPANNER WITH A DEVICE FOR RETAINING THE OBJECT TO BE TURNED

BACKGROUND OF THE INVENTION

The invention relates to a box spanner with a device for retaining the object to be turned.

Box spanners, in particular for turning sparking plugs of engines for motor vehicles, which have means for gripping the object to be turned are known. These gripping means make it possible to avoid pushing the plug, or the fastening component to be connected, onto the threaded seat, such as for example the threaded seat of the cylinder head of the engine, in advance, before using the box spanner for tightening, and make it possible to withdraw the component easily when unscrewing it, in particular in cases of difficult access or close to sources of heat, such as the cylinder head of an engine.

With these tools, it is also possible to work in very confined and deep spaces with the aid, for example, of auxiliary turning tools and, if necessary, of extensions, rendering the application of the desired twisting torque to the object to be screwed in or unscrewed both accurate and easy.

Currently, an embodiment of the retaining device of the box spanner for spark plugs consists of a ring of elastic material located in the space of the box spanner above the polygonal seat for transmission of the twisting torque. This ring, fixed to the walls of the hollow space of the spanner, has fingers projecting towards the centre of the space, which leave a central opening of a size which is smaller than the transverse dimension of the ceramic extension of the plug.

During the operation of screwing or unscrewing the plug, the ceramic body, which extends beyond the tightening nut of the plug, fits into the hollow space of the box spanner, engaging with an interference fit between the fingers projecting from the elastic ring until the polygonal surface of the nut of the plug mates with the likewise polygonal seat formed inside the mouth of the box spanner.

The disadvantage of this embodiment lies in the limited temperature variation which the elastic ring can tolerate in use. This is an unacceptable limitation of the use of the box spanner as it is essential to work both at low climatic temperatures and at the high temperatures found on internal combustion engines directly after operation. With this embodiment, however, at low temperatures, the elastic ring, which is usually made of rubber, loses elasticity, which results in a loss of grip and slipping of the plug.

On the other hand, at high temperatures, there is a tendency for the elastic ring to loosen with respect to the spanner, which brings about slipping of the ring.

A second embodiment of the retaining device for a box spanner, which is known from the prior art, consists of a permanent magnet of hollow cylindrical shape fixed to the internal surface of the hollow space of the box spanner above the polygonal seat for turning the plug. The permanent magnet of cylindrical shape has a coaxial hole of a size which is necessarily smaller than the cavity of the box spanner but large enough for the passage of the ceramic extension of the plug.

Retention of the plug is provided by the action of the permanent magnet on the metal part of the plug, which is located at the bottom of the ceramic extension.

This embodiment has the disadvantage that the cylinder of magnetic material forms a projection which partially obstructs the hollow space of the box spanner. Insertion of the plug in a manner which is not perfectly coaxial with the box spanner, which is highly likely if the spanner is being used in a situation with difficult direct access to the threaded member, brings about scraping of the very delicate surface of the ceramic extension of the plug by the magnet. This scraping may lead to damage of the ceramic part which, even if only slight, causes the plug not to function.

Breakage of the plug, which sometimes cannot even be seen, is very serious, in particular in engines with catalytic devices, since non-functioning of the spark plug may compromise the integrity of the catalytic converter resulting in very costly damage.

SUMMARY OF THE INVENTION

The aim of the present invention is to overcome the disadvantages of the prior art indicated above, and to reduce the likelihood of the ceramic part of the plug scraping against the box spanner and therefore to reduce the likelihood of damage to the plug.

A further aim of the invention is to bring about secure and efficient retention unaffected by considerable variations in operating temperature.

The aims of the invention are achieved by means of a box spanner with a device for retaining the object to be turned with an end which can be connected to auxiliary turning tools and at the open end an internal polygonal seat which can mate with the polygonal body of the object to be turned, characterized in that the polygonal seat of given spanner opening is followed by a hollow space which is delimited by the body of the box and has a transverse width essentially comparable with the spanner opening of the polygonal seat, and in that, in the sides of the polygonal seat, the body of the box has housings which accommodate permanent magnets.

Advantageously, the device for retaining the object to be turned is characterized in that the permanent magnets are located in the adjacent sides of the polygonal seat and extend around half the perimeter of the polygon.

As a further advantage, the retaining device is characterized in that, close to the open end of the box spanner, a circumferential groove suitable for accommodating an elastic ring is located on the outside.

Advantageously, the permanent magnets are fixed to the housings by means of adhesive bonding.

As a further advantage, the permanent magnets are protected by caps and are connected geometrically with an interference fit to the housings.

Advantageously, the permanent magnets and their housings formed in the body of the box are of circular section.

The following advantages are afforded by the box spanner with a retaining device according to the invention:

the hollow space of the box spanner does not have dangerous projections on the inside, thus rendering scraping between the ceramic part of the plug and the box spanner unlikely.

A further advantage lies in the fact that the retaining device thus formed grips the plug, or the object to be turned, directly on the polygonal body, facilitating, thanks to the arrangement of the magnets around one half of the perimeter of the polygonal seat, insertion and the retaining action, thus guaranteeing coaxial positioning of the box spanner with respect to the plug.

Moreover, the use of permanent magnets for gripping the metal part of the plug makes it possible to use the box spanner made according to the invention in extremely variable climatic conditions.

BRIEF DESCRIPTION OF THE DRAWINGS

The subject, designed according to the present invention, will be described in greater detail below and illustrated by means of an embodiment given only by way of example in the attached drawings, in which.

DETAILED DESCRIPTION OF THE PREFERRED EMBODIMENT

Figure 1:
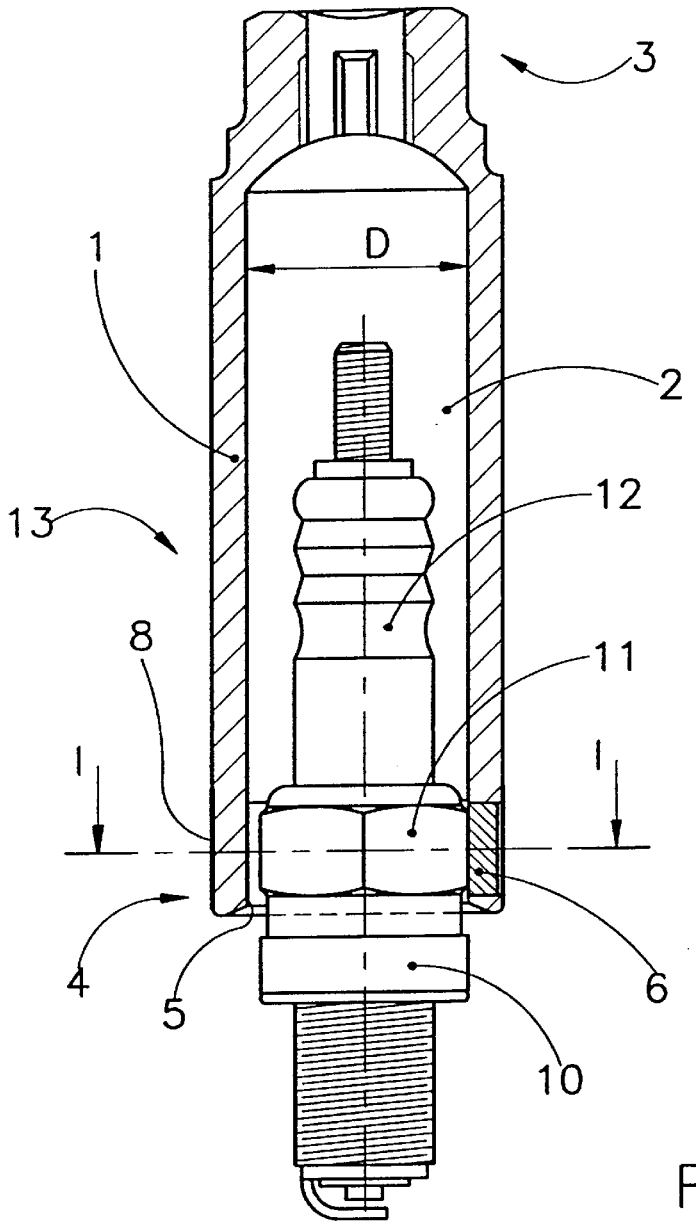
FIG. 1 shows, laterally and in section, the box spanner engaged on a sparking plug.

It can be seen from the figures that the box spanner forming the subject of the invention, indicated as a whole by 13, consists of a box 1 having at an upper end 3 an external polygonal seat and also, advantageously, an internal polygonal seat for connection to auxiliary turning tools, such as for example levers, torque wrenches or articulated extensions.

Advantageously, the box 1 may alternatively end in a connection fixed to turning members.

At the lower, open end 4, the box spanner has, on the inside, a polygonal, for example hexagonal, seat 5 which forms the surfaces for turning and transmitting the tightening torque to the fastening component that is to be turned, in particular a sparking plug 10 for a motor vehicle engine.

The body of the box 1 has on the inside a hollow space 2 which is free of projections and formed as a vertical extension of the sides of the polygonal seat 5. In this way, the transverse dimension (D) of the space 2, in the case, for example, of a space 2 of circular section, the diameter (D), corresponds to the spanner opening (K) of the polygonal seat 5.

For production reasons, there may of course be small differences between the dimension of the diameter D of the space 2 and the spanner opening K of the polygonal seat 5 which, however, do not give rise to any substantial restrictions to an accurate and convenient introduction of the object to be turned.

The body of the box 1, close to the lower end 4 and in the sides of the internal polygonal seat 5, has housings 9 in which permanent magnets 6 are inserted and fixed.

A particular advantage is that the housings 9 are formed in such a number and in such a manner on the sides of the polygonal seat 5 that they are all adjacent and arranged around the same half perimeter.

Likewise close to the lower end 4, on the outside of the body of the box 1, a horizontal groove 7 of a height equal to or greater than the polygonal seat 5 is formed. Inserted into this groove 7 is a protective elastic ring 8 for the permanent magnets 6 inserted into the body 1, which ring is necessary for closing the magnetic flux. With the closure of the magnetic flux by the elastic ring 8, the retaining action of the permanent magnets 6 is intensified.

Advantageously, the permanent magnets 6 are protected by a cap, made of brass for example, and are connected geometrically with an interference fit to the housings 9 and the elastic ring 8 ensures that they cannot come out.

The depth of the groove 7 is advantageously equal to the thickness of the elastic ring 8 in such a manner that the external surface of the box spanner has no projections, favouring safe handling.

Advantageously, the permanent magnets 6 are adhesively bonded in the housings 9, thus preventing them coming out as a result of possible knocks.

Equally advantageously, the housings 9 are in the form of through-holes of circular section and the tablet-shaped permanent magnets 6 accommodated in the holes 9 are aligned with the internal surface of the sides of the polygonal seat 5. In this way, even the smallest internal surface discontinuity of the sides of the polygonal seat 5 is avoided.

Figure 2:
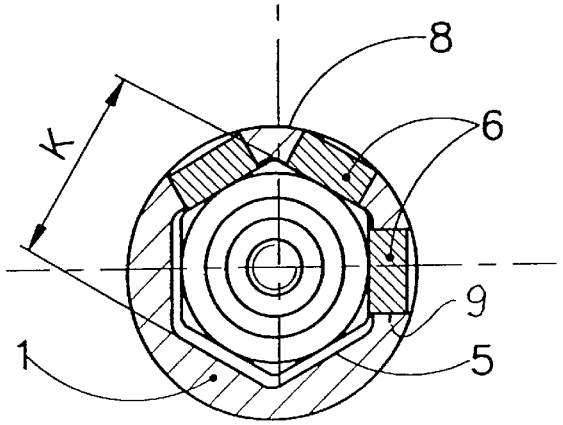
FIG. 2 illustrates the section on I—I as marked in FIG. 1.
Figure 3:
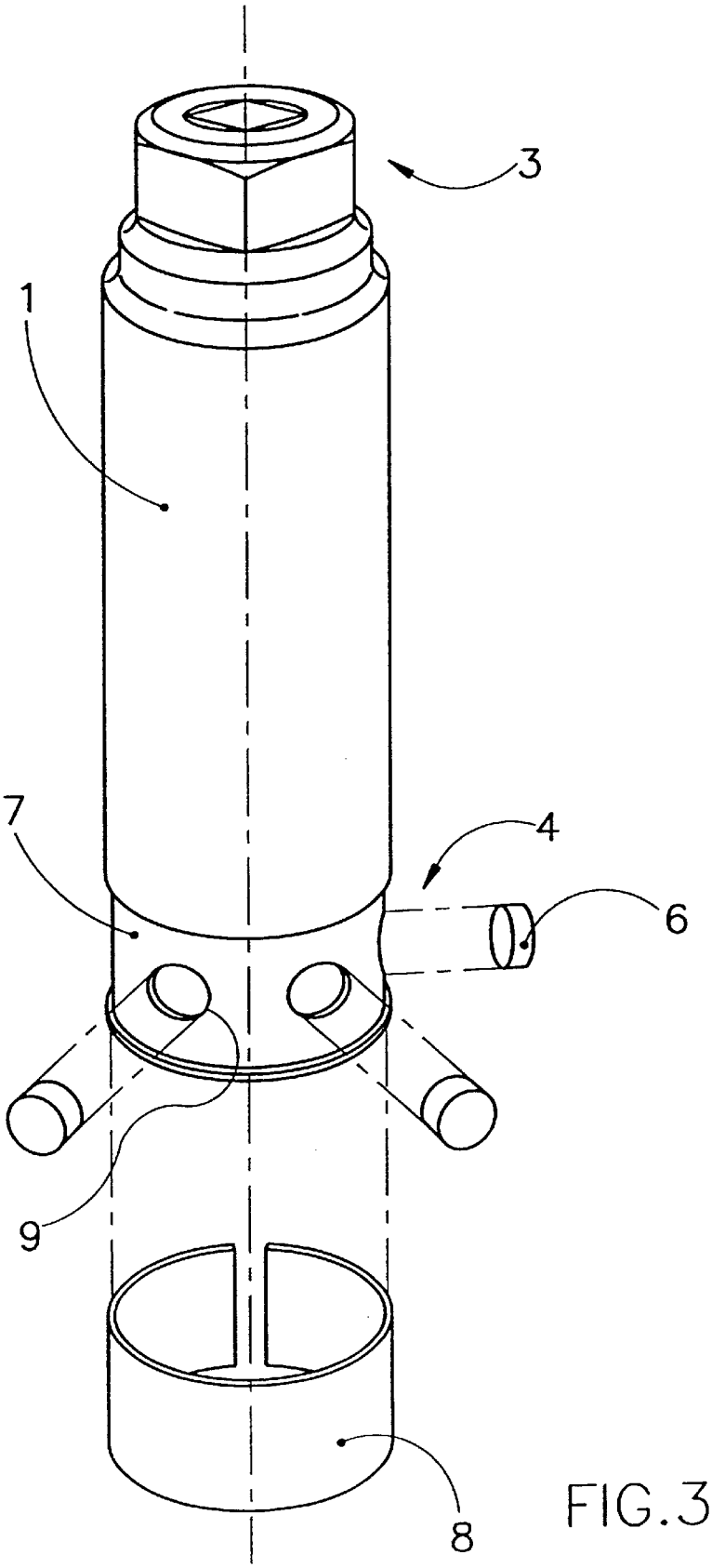
FIG. 3 shows the box spanner in an exploded axonometric view.

The way the box spanner 13 forming the subject of the invention functions in the event, for example, of a sparking plug 10 having to be unscrewed and removed from the cylinder head of a motor vehicle engine can be seen from FIGS. 1 and 2. Although the operation presupposes the insertion of the tool into a particularly confined environment, the introduction of the extension 12 of the plug 10 into the open end 4 of the box 1 is very easy, accurate and unhindered thanks to the absence of projections in the opening or in the hollow space 2 of the box spanner 13.

By virtue also of the adjacency and location of the tablets of the permanent magnets 6 on the half perimeter of the polygonal seat 5 located inside the lower end 4 of the spanner, a vectorial composition of the magnetic attraction forces is brought about, which is concentrated and orientated so as to draw the polygonal metal surface 11 of the plug 10 towards the inside of the box 1 of the spanner 13.

Moreover, the overall magnetic action is such that it orientates the plug 10 coaxially in relation to the spanner 13, so that the ceramic extension 12 does not knock or scrape internally against the wall of the space 2. This is because the polygonal metal surface 11 of the plug 10, on entering the box 1 of the spanner 13, is attracted by the semi-peripheral pull of the polygonal seat 5 of the spanner 13, where the permanent magnet 6 inserts are located, forcing the half perimeter of the polygonal seat 11 of the plug 10 to remain facing the half perimeter of the polygonal seat 5 of the spanner 13.

Once the polygonal surface 11 of the nut of the plug is facing the polygonal seat 5 of the box spanner 13, the plug 10 is of necessity coaxial with the box spanner 13.

Once the polygonal seat 5 of the spanner 13 has mated with the polygonal seat 11 of the plug 10 and the plug 10 has been unscrewed from the cylinder head of the engine, the plug 10 is firmly inserted in the space 2, thanks to the magnetic action in the box spanner 13, allowing the removal of the plug from the cylinder head of the engine.

We claim:

1. A spanner for installing and removing an object having a polygonal portion, comprising:

a) a hollow tubular member extending along a longitudinal axis between a tool end engageable with a turning tool, and a socket end having an interior polygonal seat engageable in a turning force-transmitting relationship with the polygonal portion of the object;

b) an annular peripheral groove extending around the axis at an external peripheral surface of the tubular member at the socket end;

c) a plurality of radial passages extending from the groove through the tubular member to the seat;

d) a plurality of permanent magnets respectively mounted in the passages; and e) an annular band mounted in the peripheral groove and exteriorly covering the magnets.

2. The spanner according to claim 1, wherein the polygonal seat is a hexagonal socket.

3. The spanner according to claim 1, wherein the peripheral groove has a depth dimension, and wherein the band has a thickness dimension that equals the depth dimension.

4. The spanner according to claim 1, wherein the polygonal seat has a plurality of interior, generally planar walls; and wherein each magnet has an inner face mounted flush with one of the walls.

5. The spanner according to claim 1, wherein the magnets are asymmetrically arranged relative to the axis.

6. The spanner according to claim 4, wherein there are six of the interior walls, and wherein there are three of the magnets, and wherein the three magnets are situated at three adjacent walls.

7. The spanner according to claim 1, wherein each passage and each magnet have circular cross-sections.

8. The spanner according to claim 1, wherein each magnet has a protective cap.

9. The spanner according to claim 1, wherein each magnet is fixedly secured within a respective passage.

10. The spanner according to claim 9, wherein each magnet is press-fitted in the respective passage.

11. The spanner according to claim 9, wherein each magnet is adhesively bonded in the respective passage.

12. The spanner according to claim 1, wherein the band is a split ring.

13. The spanner according to claim 1, wherein the band is constituted of a non-ferromagnetic material.

14. The spanner according to claim 1, wherein the band is constituted of an elastic material.

15. A spanner for installing and removing a spark plug having a polygonal base portion and a reduced diameter insulator portion, comprising:

a) a hollow tubular member extending along a longitudinal axis between a tool end engageable with a turning tool, and a socket end having an interior polygonal seat engageable in a turning force-transmitting relationship with the polygonal base portion of a plug, said tubular member having an interior cavity for receiving the insulator portion with clearance;

b) an annular peripheral groove extending around the axis at an external peripheral surface of the tubular member at the socket end;

c) a plurality of radial passages extending from the groove through the tubular member to the seat;

d) a plurality of permanent magnets respectively mounted in the passages; and e) an annular band mounted in the peripheral groove and exteriorly covering the magnets.

* * * * *